US010871134B2

(12) United States Patent
Grandi et al.

(10) Patent No.: US 10,871,134 B2
(45) Date of Patent: Dec. 22, 2020

(54) VALVE ASSEMBLY FOR AN INJECTION VALVE AND INJECTION VALVE

(71) Applicant: Continental Automotive GmbH, Hannover (DE)

(72) Inventors: Mauro Grandi, Leghorn (IT); Stefano Filippi, Castel' Anselmo Collesalvetti (IT); Francesco Lenzi, Leghorn (IT); Valerio Polidori, Leghorn (IT)

(73) Assignee: VITESCO TECHNOLOGIES GMBH, Hanover (DE)

( * ) Notice: Subject to any disclaimer, the term of this patent is extended or adjusted under 35 U.S.C. 154(b) by 30 days.

(21) Appl. No.: 15/762,716

(22) PCT Filed: Sep. 14, 2016

(86) PCT No.: PCT/EP2016/071693
§ 371 (c)(1),
(2) Date: Mar. 23, 2018

(87) PCT Pub. No.: WO2017/050616
PCT Pub. Date: Mar. 30, 2017

(65) Prior Publication Data

US 2018/0283334 A1 Oct. 4, 2018

(30) Foreign Application Priority Data

Sep. 24, 2015 (EP) ..... 15186729

(51) Int. Cl.
*F02M 51/06* (2006.01)
*F02M 61/20* (2006.01)
*F02M 61/18* (2006.01)

(52) U.S. Cl.
CPC ..... *F02M 51/0685* (2013.01); *F02M 61/188* (2013.01); *F02M 61/20* (2013.01); *F02M 2200/50* (2013.01)

(58) Field of Classification Search
CPC .. F02M 51/0685; F02M 61/188; F02M 61/20; F02M 2200/50
(Continued)

(56) References Cited

U.S. PATENT DOCUMENTS 6,619,269 B1 * 9/2003 Stier ..... F02M 51/0671 123/467
6,932,283 B2 * 8/2005 Stier ..... F02M 51/0685 239/533.2
(Continued)

FOREIGN PATENT DOCUMENTS

CN 102444513 A 5/2012 ..... F02M 51/06
EP 2333297 B1 3/2013 ..... F02M 51/06
(Continued)

OTHER PUBLICATIONS

Extended European Search Report, Application No. 15186729.8, 7 pages, dated Jan. 4, 2016.
(Continued)

*Primary Examiner* — Qingzhang Zhou
(74) *Attorney, Agent, or Firm* — Slayden Grubert Beard PLLC

(57) ABSTRACT

The present disclosure relates to valves. Some embodiments may include solenoid injection valves with a valve body; a valve needle with a needle shaft, an upper retaining element, and a lower retaining element; an electro-magnetic actuator comprising a pole piece and an armature spaced from the pole piece by a first axial gap when de-energized. The armature slides on the valve needle between the upper retaining element and the lower retaining element. The valve may include a calibration spring and a spring element arranged between the armature and the upper retaining element. The armature compresses the spring element and travels at least 50% of the first axial gap before an opening force of the valve assembly becomes larger than a total
(Continued)

needle closing force. An opening force for displacing the valve needle away from the closing position is transferred from the armature to the valve needle completely through the spring element and a second axial gap between the armature and the upper retaining element is maintained throughout the operation of the valve assembly.

6 Claims, 2 Drawing Sheets

(58) Field of Classification Search
USPC ..... 239/5, 585.1, 585.5, 533.2, 533.9
See application file for complete search history.

(56) References Cited

U.S. PATENT DOCUMENTS

| | | | | |
|---|---|---|---|---|
| 8,528,842 | B2 | 9/2013 | Hoang | 239/585.1 |
| 8,684,285 | B2 | 4/2014 | Imai | 239/533.14 |
| 2011/0278368 | A1* | 11/2011 | Hornby | F02M 51/0685 239/5 |
| 2015/0102135 | A1 | 4/2015 | Romeo | 239/585.4 |

FOREIGN PATENT DOCUMENTS

| | | | | |
|---|---|---|---|---|
| WO | 02/068810 | A1 | 9/2002 | F02M 51/06 |
| WO | 2005/113973 | A1 | 12/2005 | F02M 51/06 |
| WO | 2011/069793 | A1 | 6/2011 | F02M 51/06 |
| WO | 2011/143552 | A2 | 11/2011 | F02M 51/06 |
| WO | 2017/050616 | A1 | 3/2017 | F02M 51/06 |

OTHER PUBLICATIONS

International Search Report and Written Opinion, Application No. PCT/EP2016/071693, 13 pages, dated Nov. 25, 2016.
Chinese Office Action, Application No. 201680055787.9, 18 pages, dated Nov. 1, 2019.

* cited by examiner

VALVE ASSEMBLY FOR AN INJECTION VALVE AND INJECTION VALVE

CROSS-REFERENCE TO RELATED APPLICATIONS

This application is a U.S. National Stage Application of International Application No. PCT/EP2016/071693 filed Sep. 14, 2016, which designates the United States of America, and claims priority to EP Application No. 15186729.8 filed Sep. 24, 2015, the contents of which are hereby incorporated by reference in their entirety.

TECHNICAL FIELD

The present disclosure relates to valves. Teachings thereof may be embodied in a valve assembly for an injection valve and injection valves, e.g. a fuel injection valve of a vehicle. Some embodiments may include solenoid injection valves.

BACKGROUND

Injection valves must be able to dose fluids across varying levels of fuel pressure. One design to ensure this is the "free-lift" design, which is described in document EP 2 333 297 B1. According to this design, the armature of the electro-magnetic actuator unit travels about a "pre-stroke gap" before it engages the needle to open the injector. Thus, kinetic energy is accumulated before the actual opening. However, the "free-lift" design may be problematic because of multiple-injection instability and because of high instability during the lifetime of the valve.

SUMMARY

The teachings of the present invention may be embodied in a valve assembly for an injection valve that overcomes the above mentioned difficulties and which provides a stable performance even under conditions of high fluid pressure.

For example, a valve assembly (3) for an injection valve (1), may include: a valve body (4) having a longitudinal axis (L) and comprising a cavity (9) with a fluid inlet portion (5) and a fluid outlet portion (7), a valve needle (11) axially moveable in the cavity (9), the valve needle (11) preventing a fluid flow through the fluid outlet portion (7) in a closing position and releasing the fluid flow through the fluid outlet portion (7) in further positions. The valve needle (11) may include an upper retaining element (27) fixedly connected to a needle shaft (15) of the needle (11) and extending in radial direction and being arranged in an axial region of the valve needle (11) facing away from the fluid outlet portion (7) and a lower retaining element (29) fixedly connected to the needle shaft (15) and extending in radial direction and being arranged in an axial region of the valve needle (11) facing the fluid outlet portion (7). An electro-magnetic actuator unit (19) may actuate the valve needle (11), the electro-magnetic actuator unit (19) comprising a pole piece (25) and an armature (23), spaced from the pole piece (25) by an axial gap when the actuator unit (19) is de-energized, the armature (23) being axially movable in the cavity (9) and joined to the valve needle (11) by form-fit, the armature (23) being able to slide on the valve needle (11) between the upper retaining element (27) and the lower retaining element (29. A calibration spring (18) may be preloaded to bias the needle (11) towards the closing position and a spring element (31) is arranged between the armature (23) and the upper retaining element (27) and biases the armature (23) towards the lower retaining element (29). The spring element (31) and the calibration spring (18) are adapted to one another such that the armature (23) compresses the spring element (31) and travels at least 50% of the gap before an opening force of the valve assembly (3) becomes larger than a total needle closing force. An opening force for displacing the valve needle (11) away from the closing position is transferred from the armature (23) to the valve needle (11) completely through the spring element (31), and—an axial gap between the armature (23) and the upper retaining element (27) is maintained throughout the operation of the valve assembly (3).

In some embodiments, the spring element (31) is configured to allow the armature (23) to travel 70% of its lift before an opening force of the valve assembly (3) becomes larger than a total needle closing force.

In some embodiments, the spring element (31) is a high-stiffness spring element.

In some embodiments, the spring element (31) is a coil spring.

In some embodiments, in a fully open configuration of the valve assembly, the armature (23) abuts the pole piece (25) and the lower retaining element (29) and the upper retaining element (27) are axially spaced apart from the armature (23).

As another example, an injection valve (1) may include a valve assembly (3) according to the description above.

BRIEF DESCRIPTION OF THE DRAWINGS

Further advantages, embodiments, and developments of the valve assembly will become apparent from the exemplary embodiments which are described below in association with schematic figures.

DETAILED DESCRIPTION

Figure 1:
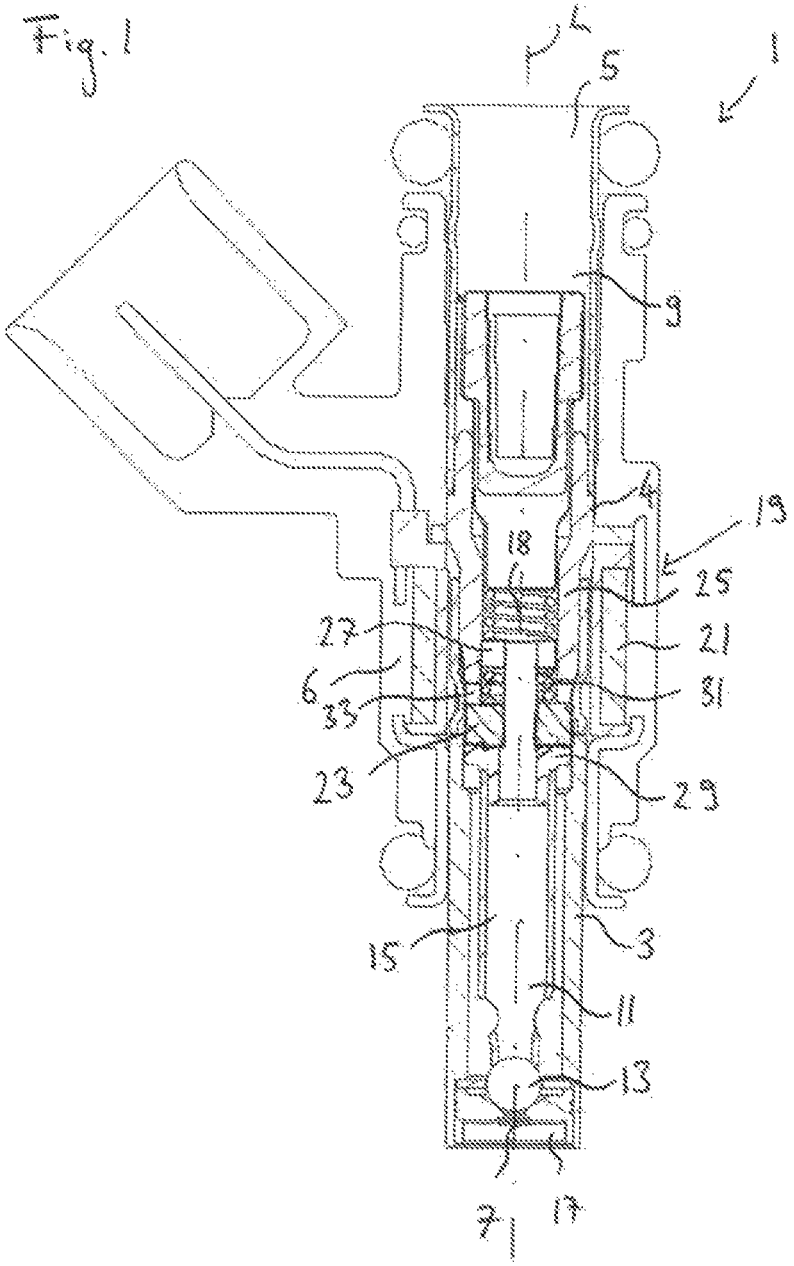
FIG. 1 shows a cross sectional view of an injection valve with a valve assembly according to one embodiment of the teachings of the present disclosure.

In some embodiments, a valve assembly for an injection valve comprises a valve body having a longitudinal axis and comprising a cavity with a fluid inlet portion and a fluid outlet portion. The valve assembly further comprises a valve needle axially moveable in the cavity. I.e. the valve needle is received in the cavity and axially movable relative to the valve body. The valve needle prevents a fluid flow through the fluid outlet portion in a closing position and releases the fluid flow through the fluid outlet portion in further positions. The valve needle comprises an upper retaining element fixedly connected to a needle shaft of the needle and extending in radial direction—i.e. extending radially outward from the shaft—and being arranged in an axial region of the valve needle facing away from the fluid outlet portion and a lower retaining element fixedly connected to the needle shaft of the needle and extending in radial direction—i.e. radially outward from the shaft—and being arranged in an axial region of the valve needle facing the fluid outlet portion. Further, the valve needle may comprise a sealing element which is, for example, ball shaped, and is fixed to the needle shaft at an end of the needle shaft facing towards the fluid outlet portion.

The valve assembly further comprises an electro-magnetic actuator unit to actuate the valve needle, the electro-magnetic actuator unit comprising an armature. The actuator unit may comprise a solenoid and a pole piece. The armature is axially movable in the cavity and joined to the valve needle by form-fit, the armature sliding on the valve needle between the upper retaining element and the lower retaining element. In other words, the armature is positioned in the cavity. It is axially displaceable relative to the valve body and also relative to the needle. Axial displaceability of the armature relative to the needle is limited by the upper retaining element in one axial direction and by the lower retaining element in the opposite axial direction.

A spring element is arranged between the armature and the upper retaining element. Expediently, the spring element may bias the armature towards the lower retaining element, such that the armature bears against the lower retaining element when the actuator unit is de-energized.

The valve assembly may comprise a calibration spring. The calibration spring is preloaded to bias the needle towards the closing position. The calibration spring is arranged such that it presses against the upper retainer on its side remote from the armature, i.e. in particular remote from the fluid outlet portion.

In a closing position of the valve, the spring element may be in contact with both the armature and the upper retaining element and carry a comparatively low amount of energy, i.e. is comparatively little compressed or not at all. In an opening phase of the valve, the armature slides on the valve needle away from the fluid outlet portion, i.e. it moves axially towards the upper retaining element.

There is no direct way of transferring force between the armature and the needle. The armature therefore does not engage the needle directly. In some embodiments, an axial gap between the armature and the upper retaining element is maintained throughout the operation of the valve assembly. In other words, the armature does not engage in a form-fit connection with the needle for moving the needle away from the closing position. Instead, the armature acts on the spring element and compresses it while moving. Hence, the spring element is loaded with energy by the armature. Because of the contact between the spring element and the upper retaining element, the spring element acts on the upper retaining element and thereby on the valve needle. In this way, an opening force for displacing the needle away from the closing position—against the bias of the calibration spring—is transferred from the armature to the needle completely through the spring element.

In a first phase of the opening transient of the armature, the force exerted by the spring element is not sufficient to open the valve against the total needle closing force, i.e. the sum of the calibration spring preload and the hydraulic load exerted by the fluid under high pressure. But as the armature travels on the needle, the energy stored in the spring element builds up until it is sufficient to move the needle and open the valve. At this moment, the armature has reduced the axial gap, which separates the armature from the pole piece, by a considerable amount. Therefore, the armature is closer to the pole piece and the magnetic force acting on the armature is larger. In addition to this larger magnetic force, the energy already stored in the spring element adds to the opening of the valve.

Consequently, the needle starts to move sooner and/or faster than in conventional designs and the fluid delivery slope increases faster. Even under conditions of high fluid pressure the valve assembly provides a stable and reliable performance.

The spring element arranged between the armature and the upper retaining element functions as energy storage during the opening phase of the valve. Therefore, the spring element is configured—e.g. by its axial length and its stiffness—that, in particular during the opening transient of the armature, the armature compresses the spring element partially before an opening force of the valve assembly becomes larger than a total needle closing force. When the opening force becomes larger than the total needle closing force, the needle starts moving away from the closing position.

The total needle closing force is defined as the sum of the calibration spring preload and the hydraulic load exerted by the fluid. The opening force of the valve assembly is defined as the force acting in opening direction on the needle, i.e. the force exerted by the spring element on the upper retainer.

The axial length and stiffness of the spring element are chosen appropriately to allow the armature to compress the spring element partially before the needle opens. Hence, there is no direct force transfer between armature and needle. Instead, the spring element acts in between. In the moment the valve opens, there is a larger amount of energy available for the opening because of the energy stored in the spring element which is released.

In some embodiments, the spring element is configured—by its axial length and its stiffness—to allow the armature to travel at least 50%, or as much as 70% of its lift before an opening force of the valve assembly becomes larger than a total needle closing force. In some embodiments, the spring element and the calibration spring are adapted to one another—by means of the length and stiffness of the spring element—that the armature compresses the spring element and travels at least 50%, e.g., 70% of its lift before an opening force of the valve assembly becomes larger than a total needle closing force. The lift of the armature is defined as the gap between the armature and the pole piece. As the armature is stopped by the pole piece, this is the length which the armature travels relative to the valve body during the opening transient.

In other words, the armature is spaced apart from the pole piece by the axial gap between the armature and the pole piece when the actuator unit is de-energized. The armature moves towards the armature and closes the gap for moving the valve needle away from the closing position when the actuator unit is energized. Due to the displacement of the armature while the opening force of the valve assembly is smaller than the total needle closing force, the lift of the armature is larger than the needle lift.

When the armature has traveled such a length already before the valve starts to open, it is considerably closer to the pole piece in the moment of the opening. Hence, it experiences a considerably higher magnetic force. In contrast to this, in a standard design of an injection valve, the needle starts to open when the armature is at the maximum distance from the pole piece. In addition, the needle may be accelerated to move faster than the armature by due to the spring force of the spring element which has been compressed by the armature. In this way, a fully open position of the needle may be reachable particularly fast.

In some embodiments, the spring element is a high-stiffness spring element. The stiffness of the spring element is typically larger that of the calibration spring and may be at least twice as large, for example. In one embodiment, the stiffness is between two and ten times as large as the stiffness of the calibration spring, the limits being included. This makes it possible to store enough energy in the spring to open the valve. The spring element may comprise a coil spring. A coil spring can easily be fitted around the needle and inserted into the pole piece.

In some embodiments, in a fully open configuration of the valve assembly, the armature abuts the pole piece and the lower retaining element while the upper retaining element is axially spaced apart from the armature. In addition, the armature may also abut the lower retaining element in a closed configuration of the valve assembly when the actuator unit is de-energized and the needle is in the closing position. In this way, the armature lift and the needle lift may be precisely defined. The stroke and/or the opening and/or closing transients of the valve may therefore be precise and/or reproducible and/or well controllable.

In some embodiments, an injection valve is provided with a valve assembly according to the preceding description. The injection valve may be a fuel injection valve for a vehicle. Such an injection valve may have the advantage that it has a stable performance even in conditions of high fuel pressure and is reliable and durable. The needle starts to move sooner and/or faster as compared to a standard design because the armature is closer to the pole piece and the magnetic force builds up faster. When the armature is in contact with the pole piece, the energy stored in the spring element is in particular sufficient to complete the needle opening transient even at high fuel pressure. Hence, no additional energy is required to operate the injector at higher fuel pressure.

FIG. 1 shows an injection valve 1 suitable for dosing fuel to an internal combustion engine. The injection valve 1 comprises a valve assembly 3. The valve assembly 3 comprises a valve body 4 with a central longitudinal axis L. A housing 6 is partially arranged around the valve body 4.

The valve body 4 comprises a cavity 9. The cavity 9 has a fluid outlet portion 7. The fluid outlet portion 7 communicates with a fluid inlet portion 5 which is provided in the valve body 4. The fluid inlet portion 5 and the fluid outlet portion 7 are positioned at opposite axial ends of the valve body 4. The cavity 9 takes in a valve needle 11. The valve needle 11 comprises a needle shaft 15 and a sealing ball 13 welded to the tip of the needle shaft 15.

In a closing position of the valve needle 11, it sealingly rests on a seat plate 17 having at least one injection nozzle. A preloaded calibration spring 18 exerts a force on the needle 11 towards a closing position. The fluid outlet portion 7 is arranged near the seat plate 17. In the closing position of the valve needle a fluid flow through the at least one injection nozzle is prevented. The injection nozzle may be, for example, an injection hole. However, it may also be of some other type suitable for dosing fluid.

The valve assembly 3 is provided with an electro-magnetic actuator unit 19. The electro-magnetic actuator unit 19 comprises a coil 21, which may be arranged inside the housing 6. Furthermore, the electro-magnetic actuator unit 19 comprises the armature 23. The housing 6, parts of the valve body 4 and the armature 23 are forming an electro-magnetic circuit. The actuator unit 19 further comprises a pole piece 25.

The armature 23 is axially movable in the cavity 9. The armature 23 is separate from the valve needle 11 and is axially movable relative to the valve needle 11 and to the valve body 4. Fixed to the needle shaft 15 are an upper retaining element 27 and a lower retaining element 29. The upper retaining element 27 is arranged in an axial region of the valve needle 11 facing away from the fluid outlet portion 7. The lower retaining element 29 is arranged in an axial region of the valve needle 11 facing the fluid outlet portion 7.

Between the armature 23 and the upper retaining element 27, a spring element 31 is arranged. The spring element 31 is a high-stiffness coil spring.

When the valve assembly 3 is at rest in a closed position, there is a gap 33 between the pole piece 25 and the armature 23. When the coil 21 is energized, the armature 23 is displaced relative to the valve body 3 until it reaches the pole piece 25 and the gap 33 is closed. At the same time, the armature 23 compresses the spring element 31. When the force exerted by the compressed spring element 31 on the upper retaining element 27 becomes large enough, the needle 11 also starts moving so that is axially displaced away from the closing position and the valve opens against the force of the calibration spring 18.

Figure 2:
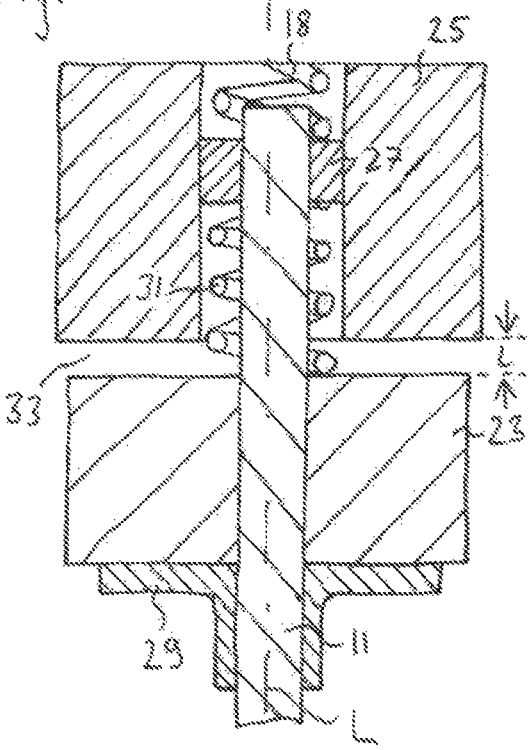
FIG. 2 shows a cross section of the valve assembly according to FIG. 1 in a first closed position.

Details of the opening and closing process are described with reference to FIGS. 2 to 5. FIG. 2 shows the valve assembly 3 in a first closed position. In the first position, the valve assembly 3 is at rest with the actuator unit 19 being de-energized. In particular, the coil 21 is not energized.

The armature 23 is in contact with the lower retaining element 29. There is a gap 33 between the armature 23 and the pole piece 25. The width of the gap 33—i.e. its axial dimension—defines the lift 1 of the armature 23.

Figure 3:
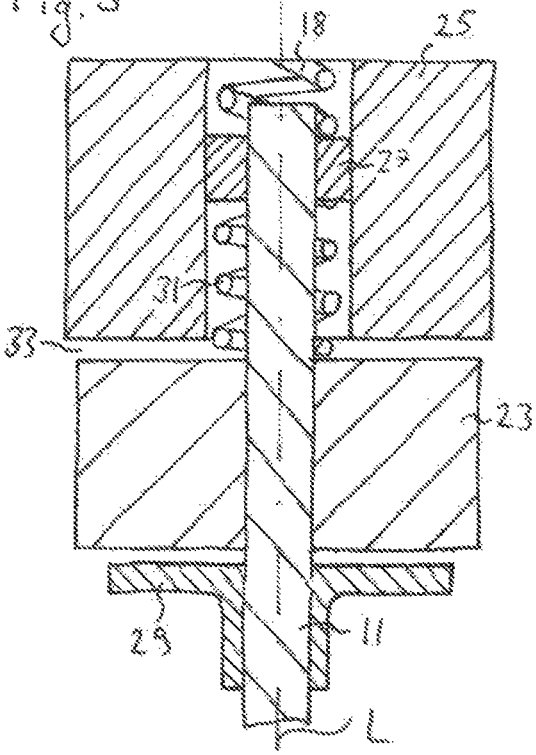
FIG. 3 shows a cross section of the valve assembly according to FIG. 1 in a second closed position.

FIG. 3 shows the valve assembly 3 in a second closed position, shortly after the coil 21 has been energized for initiating the opening transient of the valve assembly 3. The magnetic force on the armature 23 increases. When it is larger than the spring force of the spring element 31, the armature 23 starts to move axially relative to the valve body 3 towards the pole piece 25. The gap 33 starts to close.

The needle 11 does not move at this point. The valve is still closed. Instead, the armature 23 also moves axially relative to the needle 11 so that it approaches the upper retaining element 27 and, thus, compresses the spring element 31. Due to this compression, the spring element 31 starts to exert a force on the needle 11 by means of the upper retaining element 27. The force exerted on the needle 11 by the spring element 31 increases as the armature 23 moves further towards the upper retaining element 27. It is axially directed away from the fluid outlet portion 7.

Figure 4:
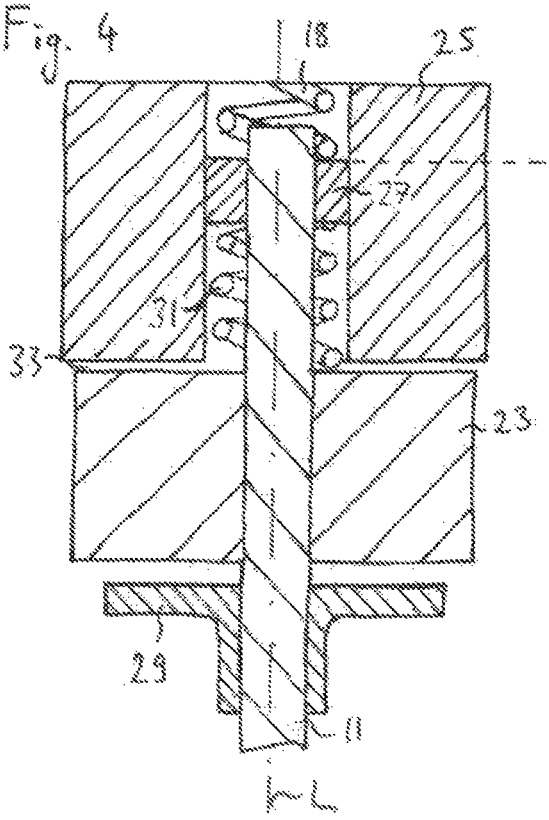
FIG. 4 shows a cross section of the valve assembly according to FIG. 1 in a partially opened position.

FIG. 4 shows the valve assembly 3 at the moment when the force exerted by the compressed spring element 31 on the needle 11 is large enough to overcome the total needle closing force, i.e. the sum of the calibration spring preload and the hydraulic load. The needle 11 begins to move and the valve starts to open. Until this point in time—or, respectively, this axial position of the armature 23 with respect to the valve body 3—the energy transferred from the moving armature 23 to the spring element 31 was stored in the compressed spring element 31.

The gap 33 has been reduced by 70% of the lift 1 at the point when the needle 11 starts top open. Because the armature 23 is now closer to the pole piece 25, the magnetic force acting on it is larger than in the axial positions of the armature 23 shown in FIGS. 2 and 3.

Figure 5:
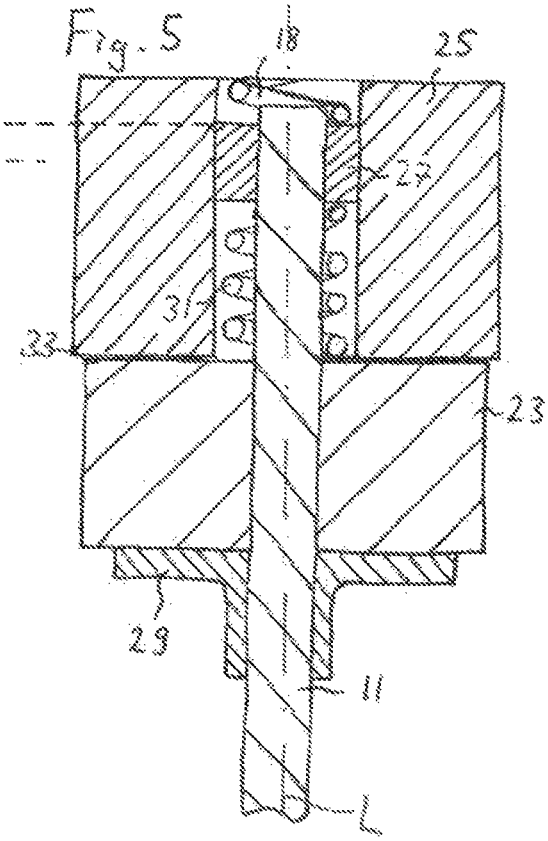
FIG. 5 shows a cross section of the valve assembly according to FIG. 1 in a fully opened position.

FIG. 5 shows the valve assembly 3 in an open position of the valve. The gap 33 is completely closed. The armature 23 is in contact with the pole piece 25. The spring element 31 moves the needle 11 away from the closing position by releasing the compression force. The needle 11 moves upwards—i.e. in axial direction away from the fluid outlet portion 7—until it reaches its full lift, when the lower retaining element 29 is in contact with the armature 23 again. This is shown in FIG. 5.

The arrangement of the armature 23 between the upper and the lower retaining elements 27, 29 ensures a defined opening and closing of the needle 11. The lower retaining element 29 prevents the needle 11 from moving uncontrollably further upwards after the armature 23 has reached the pole piece 25. It provides a hard stop for the needle 11 and a well defined opening position for the armature 23.

What is claimed is:

1. An injection valve comprising:

a valve body having a longitudinal axis and a cavity with a fluid inlet portion and a fluid outlet portion;

a valve needle axially moveable in the cavity to prevent a fluid flow through the fluid outlet portion in a closing position and releasing the fluid flow through the fluid outlet portion in further positions;

the valve needle comprising a needle shaft, an upper retaining element and a lower retaining element both fixedly connected to the needle shaft;

the upper retaining element extending in a radial direction and disposed in a first axial region of the valve needle facing away from the fluid outlet portion;

the lower retaining element extending in the radial direction and arranged in a second axial region of the valve needle facing the fluid outlet portion;

an electro-magnetic actuator unit to actuate the valve needle, the electro-magnetic actuator unit comprising a pole piece and an armature spaced from the pole piece by a first axial gap when the electro-magnetic actuator unit is de-energized;

the armature axially movable in the cavity and joined to the valve needle by form-fit;

the armature sliding on the valve needle between the upper retaining element and the lower retaining element;

a calibration spring preloaded to bias the valve needle towards the closing position; and a spring element arranged between the armature and the upper retaining element which biases the armature towards the lower retaining element;

wherein the spring element and the calibration spring are adapted to one another such that the armature compresses the spring element and travels at least 50% but no more than 70% of the first axial gap before an opening force for displacing the valve needle away from the closing position becomes larger than a total needle closing force, thereby initiating a displacement of the valve needle away from the closing position before the armature comes into contact with the pole piece;

the opening force for displacing the valve needle away from the closing position is transferred from the armature to the valve needle completely through the spring element throughout a full range of axial displacement of the armature during the operation of the valve assembly; and the armature and the upper retaining element remain spaced apart from each other throughout the full range of axial displacement of the armature during the operation of the valve assembly.

2. An injection valve according to claim 1, wherein the spring element allows the armature to travel 70% of the first axial gap before the opening force of the valve assembly becomes larger than the total needle closing force.

3. An injection valve according to claim 1, wherein the spring element has a higher stiffness than the calibration spring.

4. An injection valve according to claim 1, wherein the spring element comprises a coil spring.

5. An injection valve according to claim 1, wherein, in a fully open configuration of the valve assembly, the armature abuts the pole piece and the lower retaining element and the upper retaining element are axially spaced apart from the armature.

6. An injection valve according to claim 1, wherein the spring element has a stiffness between 2 and 10 times a stiffness of the calibration spring.

* * * * *